US005172127A

United States Patent [19]

Josefsson

[11] Patent Number: 5,172,127

[45] Date of Patent: Dec. 15, 1992

[54] WAVEGUIDE ANTENNA HAVING A PLURALITY OF BROAD-SIDE SLOTS PROVIDED WITH A SPATIAL FILTER

[75] Inventor: Lars G. Josefsson, Askim, Sweden

[73] Assignee: Telefonaktiebolaget L M Ericsson, Stockholm, Sweden

[21] Appl. No.: 658,589

[22] Filed: Feb. 21, 1991

[30] Foreign Application Priority Data

Mar. 19, 1990 [SE] Sweden ..... 9000959

[51] Int. Cl.[5] ..... H01Q 13/10

[52] U.S. Cl. ..... 343/771; 343/753; 343/909

[58] Field of Search ..... 343/771, 756, 909, 767, 343/770, 753

[56] References Cited

U.S. PATENT DOCUMENTS

| | | | |
|---|---|---|---|
| 2,659,005 | 11/1953 | Gruenberg | 343/771 |
| 3,303,505 | 2/1967 | Bacon et al. | 343/771 |
| 4,021,812 | 5/1977 | Schell et al. | 343/753 |
| 4,169.268 | 9/1979 | Schell et al. | 343/909 |
| 4,431,997 | 2/1984 | Sasser et al. | 343/770 |
| 4,495,506 | 1/1985 | Sasser et al. | 343/753 |
| 4,841,308 | 6/1989 | Terakawa et al. | 343/771 |
| 5,028,933 | 7/1991 | Stangel et al. | 343/771 |

FOREIGN PATENT DOCUMENTS 2390027 12/1978 France .

*Primary Examiner*—Rolf Hille
*Assistant Examiner*—Hoanganh Le
*Attorney, Agent, or Firm*—Burns, Doane, Swecker & Mathis

[57] ABSTRACT

A waveguide antenna (1) having a plurality of broad-side slots (S1–S3) is provided with one or more spatial filters (I, II) for suppressing the grid lobes (GL1,GL2) which occur in the radiated field as a result of the positioning of the slots. According to one embodiment, the spatial filter comprises two sections (I, II). The first section (I) comprises a box-like part which is mounted on the long side of the antenna waveguide (1) towards the slots (S1–S3) and has a height extension ($a_1$) which is greater than or equal to the height extension (a) of the antenna waveguide. The other section (II) comprises two parallel walls which extend in the direction of the antenna axis. There is formed in this way an interface layer (G) which causes the grid lobes to be reflected back to the antenna aperture. A further embodiment of a spatial filter for the antenna waveguide is described.

2 Claims, 2 Drawing Sheets

WAVEGUIDE ANTENNA HAVING A PLURALITY OF BROAD-SIDE SLOTS PROVIDED WITH A SPATIAL FILTER

TECHNICAL FIELD

The present invention relates to a waveguide antenna having a plurality of antenna elements which are provided with a spatial filter for the purpose of suppressing the so-called grid lobes which occur as a result of the positioning of the slots.

BACKGROUND ART

Waveguide antenna with antenna elements in the form of broad-side slots and group antennas which include a plurality of such waveguide antennas are known to the art and are found described, for instance, in SE-B-442 074. The waveguide antenna consists of a waveguide element and a plurality of transverse slots disposed along one broad side. A feed waveguide to the waveguide antenna is connected to the other broadside through an opening, normally located in the center of the antenna waveguide. The feed waveguide feeds in a field having a certain free wavelength $\lambda_o$ and the slotted antenna waveguide radiates a field of given distribution through the slots. All slots produce a common field picture which forms the antenna diagram of the antenna concerned.

Spatial filters for group antennas which comprise a plurality of antenna elements are known to the art, see for instance "IEEE Trans. on Antennas & Propagation", Mar. 1976, pages 174–187. The filters of these known designs are placed freely from the antenna itself.

DISCLOSURE OF THE INVENTION

In the case of the kind of wavelength antennas described in the introduction, the slots are placed at relatively wide distances apart, for instance at a spacing of $\geqq\lambda_o$, where $\lambda_o$ is the free wavelength of the field. It is namely necessary to select a slot spacing which is sufficiently large to correspond to the wavelength length in the antenna waveguide (distance $\approx\lambda_g$) in order for the fields from the slots to be in phase with one another. Slots which are positioned with the aforesaid spacing will, however, give rise to so-called grid lobes, which are undesirable.

The present invention is a device and method to reduce or eliminate the presence of grid lobes in the field radiated from a slotted wavelength antenna, by using spatial filters.

The inventive waveguide antenna is characterized by the features set forth in the characterizing clause of claim 1.

BRIEF DESCRIPTION OF THE DRAWINGS

The invention will now be described in more detail with reference to the accompanying drawings.

BEST MODES OF CARRYING OUT THE INVENTION

Figure 1:
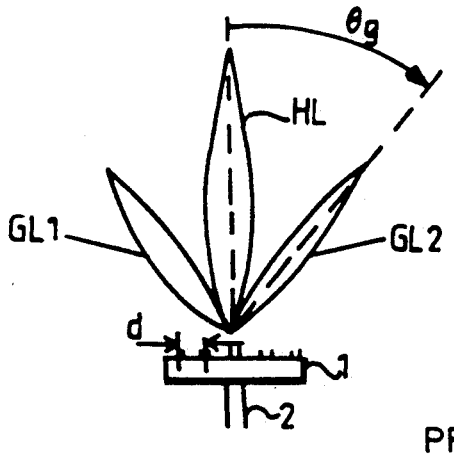
Fig.1 PRIOR ART
FIG. 1 illustrates schematically a field picture obtained with a slotted waveguide antenna of known kind.

FIG. 1 illustrates schematically a waveguide antenna in which the antenna waveguide is referenced 1 and a feed waveguide is referenced 2. The antenna waveguide 1 is provided with slots or apertures which are mutually spaced at a distance d. A field having a given free wavelength $=\lambda_o$ is fed through the feed waveguide 2, the wavelength of this field in the antenna waveguide hereinafter being designated $\lambda_g$. As is illustrated in FIG. 1, all slots give a common field picture. There is obtained a main lobe HL which extends perpendicularly to the longitudinal axis of the antenna waveguide, and two dominating grid lobes GL1, GL2, each of which forms a given angle $\theta_g$ on a respective side of the main lobe extension (0°). The grid lobes may be almost as strong as the main lobe. Consequently, it is desirable to suppress these lobes, unless they are desirable for other reasons.

The slots in the antenna waveguide 1 form a grid or lattice. As before mentioned, d must be greater than $\lambda_o$ in order to obtain phase similarity of the field obtained from the individual slots. This means that $d\approx\lambda_g$. Since $\lambda_g>\lambda_o$, this means that d will be greater than $\lambda_o$. However, an antenna grid in which d is greater than $\lambda_o$ results in a main lobe HL and grid lobes GL1, GL2, both when feeding from the antenna port and when feeding to the antenna port (outside field to the antenna). The directional sense of the grid lobes is contingent on the extent to which d differs from $\lambda_o$ in accordance with the relation:

$$\sin\theta_g=\lambda_o/d$$

In accordance with the invention, known spatial filters, for instance spatial filters described in the aforesaid reference, for the purpose of suppressing the grid lobes and also for the purpose of utilizing reflected grid lobes to strengthen, to some extent, an outgoing (feed from the antenna port) or an incoming main lobe (feed from an incoming field). Distinct from the known use of the spatial filter, this filter is integrated directly in the antenna structure, by being incorporated, for instance, with a slotted waveguide (FIG. 1). A large antenna can then be built-up with a plurality of such integrated part structures.

Figure 2A:
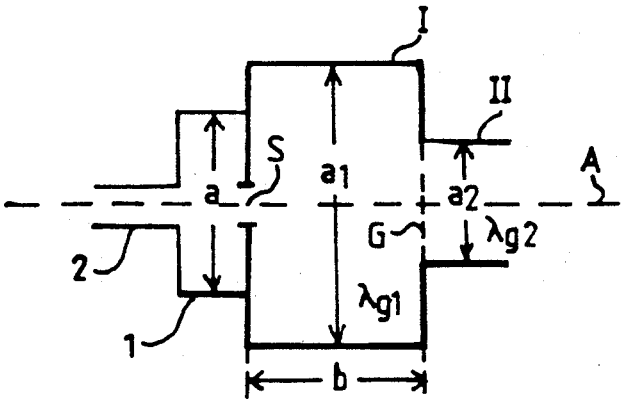
FIGS. 2a–2c illustrate various embodiments of an inventive waveguide antenna.

FIG. 2a illustrates an embodiment of an inventive waveguide antenna, seen in a cross-section through the antenna structure. The antenna waveguide and the feed waveguide are referenced 1 and 2 respectively, as in the earlier case. A first section I of the spatial filter is positioned in front of the antenna waveguide 1 to allow interaction with the field radiated from the waveguide. The section I comprises a box-like part having a height extension $a_1$ which may be greater than or equal to the height extension a of the antenna waveguide 1. This latter case ($a_1=a$) enables several antenna waveguides with associated space filters to be combined to form a large antenna unit. The section I may have any desired depth or width b and the depth of the section is chosen with regard to the space required for the antenna structure as a whole. In the illustrated embodiment, the section I merges with the antenna waveguide 1 and merges stepwise with a second section II, which comprises two parallel walls extending in the direction of the antenna axis A. The section II forms an opening for the section I. The height of the section II, i.e. the distance between the walls, is $a_2$. All walls of the two sections I and II are made of a metallic material and the interior space of the sections may be filled with air or with a suitable dielectric medium.

Figure 2B:
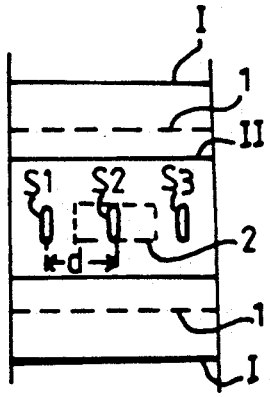

FIG. 2*b* illustrates the same antenna structure as that shown in FIG. 2*a*, seen from the outside and in towards the antenna aperture. FIG. 2*b* shows the positions of the slots S1, S2 and S3 in the antenna waveguide 1. The slots S1, S2, S3 form the antenna aperture.

The field that appears in section I when feeding the antenna aperture S1–S3 has a polarization which is parallel with the two side walls of the section I. There is obtained in this section a wavelength:

$$\lambda_{g1}=\lambda_o/\sqrt{1-(\lambda_o/2a_1)^2}$$

The second section II is intended to suppress the grid lobes of the field radiated from the aperture S1–S3. The following relation applies for the waveguide wavelength in section II $$\lambda_{g2}=\lambda_o/\sqrt{1-(\lambda_o/2a_2)^2}.$$

If $a_2<a_1$, as illustrated in FIG. 2*a*, 2*b*, then $\lambda_{g2}>\lambda_{g1}$. Thus, from the aspect of radiation, the section II constitutes an electromagnetically a "thinner" medium than the section I (compare for instance the transition water-air). Grid lobes which are obliquely incident to the interface layer G from section I to section II are reflected totally when $$\sin\theta_g \geqq \lambda_{g1}/\lambda_{g2}.$$

The angle $\theta_g$ is determined by the slot spacing d and the waveguide wavelength $\lambda_{g1}$ according to $$\sin\theta_g=\lambda_{g1}/d.$$

Thus, the following condition applies in order to suppress grid lobes having a given direction $\theta_g$:

$$\lambda_{g1}/\lambda_{g2}\leqq\lambda_{g1}/d \text{ or}$$

$$\lambda_{g2}\geqq d$$

In one application, the antenna waveguide is resonant (short circuited at its end surfaces) with transversal slots, as shown in FIG. 2*b*, wherein the slot spacing $d=\lambda_g$ (=waveguide wavelength) and $$\lambda_{g2}\geqq\lambda_g, \text{ which means that } a_2<a.$$

The distance $a_1$ lacks significance in this connection and can be chosen in accordance with other aspects.

Figure 2C:
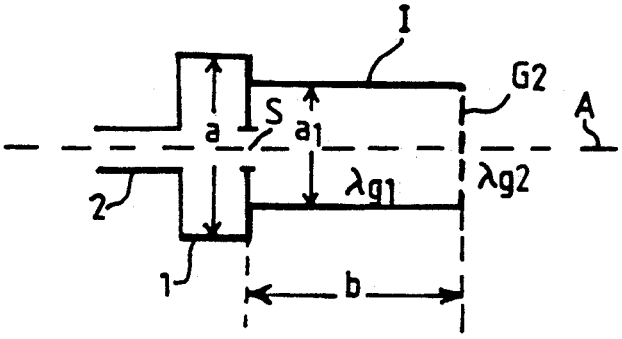

FIG. 2*c* shows a further embodiment of the waveguide antenna according to the invention as seen in a cross-section through the antenna structure. As in the embodiment according to FIG. 2*a*, the antenna waveguide is referenced by 1 and the feed waveguide by 2. The embodiment according to FIG. 2*c* distinguishes from the embodiment according to FIG. 2*a* only thereby that the first section has been taken away, i.e. $b=0$, thus $a_1=a_2$ such as only one section which corresponds to the section II in FIG. 2*a* has been created towards the free space. In FIG. 2*c*, the wavelength of the electromagnetic field within the section I is designated $\lambda g_1$ and the wavelength in free space outside the section is $\lambda g_2=\lambda_0$, thus $\lambda g_1>\lambda_0$ is valid.

The interface layer of interest is here designated G2, situated between the inner space of section I and the free space.

Figure 3:
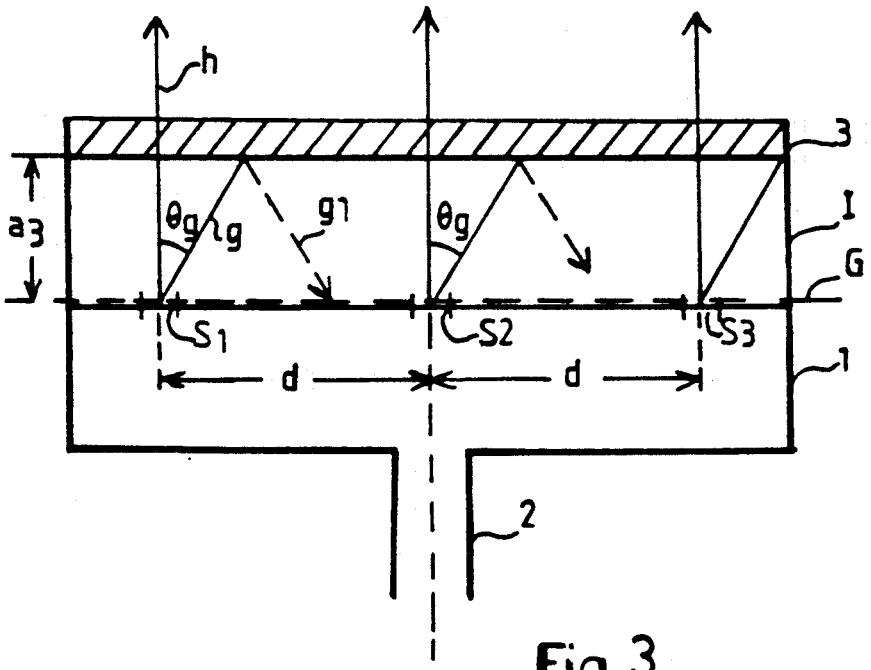
FIG. 3 illustrates still another embodiment of an inventive waveguide antenna.

FIG. 3 illustrates another embodiment of the inventive antenna structure. There is arranged on the antenna waveguide 1 having the slots S1–S3 a spatial filter with solely one closed section I which forms a space of given height $a_3$ in front of the antenna aperture.

Similar to the embodiment illustrated in FIGS. 2*a*, 2*b*, the field from each slot contributes to a total field from the antenna, with a main lobe which is perpendicular to the antenna aperture. In addition, grid lobes are obtained at an angle $\theta_g$ from the normal. The upper part of the section I comprises a wall 3 made, for instance, solely of dielectric material or from both dielectric and conductive material. The wall 3 shall have good radiation transmission properties in the direction of the main lobe ($\theta_g=0$) and progressively poorer transmission properties for increasing values of $\theta_g$. The wall 3 shall be substantially reflecting for grid lobes which define angles $\theta_g>30°$ for instance.

A given waveguide wavelength $\lambda_{g1}$ is obtained in the closed space formed by the section I and wall 3. If this wavelength is chosen so that $$d<\lambda_{g1}$$

no grid lobes at all are obtained, since $$\sin\theta_g=\lambda_{g1}/d \text{ according to the above.}$$

This applies despite the fact the free wavelength $\lambda_o$ can be $<d$. The plane-parallel structure illustrated in FIG. 3, with solely one space filter section, "filters" the field so that the field will be more homogenous, with radically reduced grid lobe amplitudes, at the outer aperture (the upper surface of the wall 3). The section I can be described as a "thinner" medium than the medium in the antenna waveguide 1, insomuch as the chosen wavelength in section I is greater than in the waveguide.

In this case, the interface layer G between the electromagnetically denser and thinner media has been formed at the antenna aperture to section I. The distance or spacing d of the antenna elements shall therewith be smaller than 1 (one) expressed in wavelengths. The grid lobe field is then attenuated exponentially in section I. Its height extension $a_3$ may be in the order of one free-space wavelength $\lambda_o$.

The waveguide structure is not restricted to the described case in which the antenna elements have the form of slots. The antenna elements may alternatively comprise dipole elements, for instance. Neither is it necessary to arrange the feed waveguide 2 in the manner illustrated in the figures. The feed waveguide 2 may alternatively be mounted on the short side of the antenna waveguide 1, so that the field is fed-in parallel with the long sides of the waveguide, which can simplify feeding of the field. Other variants are also possible.

I claim:

1. A method for suppressing grid lobes in a field having a main lobe with a fixed direction and the grid lobes, and radiating from apertures spaced apart at a determined distance along one side of an antenna waveguide, comprising the steps of:

positioning a first section of a spatial filter containing a first electromagnetic medium proximate the apertures to allow interaction with the field;

positioning a second section of the spatial filter containing a second electromagnetic medium, the second medium being thinner than the first medium, and having a height extension less than a height extension of the first section, proximate the first section to allow further interaction with the field, the first section height extension being greater than or equal to a height extension of the waveguide and the height extension of the waveguide being greater than the height extension of the second section; and separating the first and second electromagnetic mediums.

2. A waveguide antenna comprising:

a plurality of antenna apertures spaced apart at a determined distance along one long side of an antenna waveguide;

a feed waveguide to feed electromagnetic field energy to the antenna apertures therewith exciting an electromagnetic field having a main lobe with a fixed direction and associated grid lobes; and, a spatial filter positioned proximate the antenna apertures to allow interaction with the field and having a first and a second section, the first section being positioned between the waveguide and the second section and each section having two parallel walls extending in the same direction as the apertures of the antenna waveguide, a height extension ($a_2$) between the parallel walls of the second section being smaller than a height extension ($a_1$) of the corresponding parallel walls of the first section, so as to form an interface separating an electromechanically denser medium from a thinner medium, and a wavelength of the field in the antenna being greater tin the thinner medium than in the denser medium, the first section of the spatial filter covering the antenna apertures along a length of the antenna waveguide and stepwise merging with the second section which is open to the field to form the interface, and the height extension ($a_1$) of the first section is greater than or equal to a height extension (a) of the antenna waveguide and the height extension ($a_2$) of the second section is smaller than the height extension (a) of the antenna waveguide, so that a wavelength $\lambda_{g2}$ of the field in the second section is greater than a wavelength $\lambda_{g1}$ of the field in the first section, and the grid lobes are totally reflected when $$\sin \theta_g \geqq \lambda_{g1}/\lambda_{g2}$$

where $\theta_g$ is a directional sense of the grid lobes relative to a directional sense of the main lobe.

* * * * *